US009325076B2

(12) United States Patent
Bishop et al.

(10) Patent No.: US 9,325,076 B2
(45) Date of Patent: Apr. 26, 2016

(54) ANTENNA FOR WIRELESS DEVICE

(75) Inventors: Bruce Foster Bishop, Aptos, CA (US); Yong Kwon Park, Capitola, CA (US); Junwon Kim, Capitola, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 485 days.

(21) Appl. No.: 13/445,602

(22) Filed: Apr. 12, 2012

(65) Prior Publication Data

US 2013/0271330 A1 Oct. 17, 2013

(51) Int. Cl.
*H01Q 9/00* (2006.01)
*H01Q 15/00* (2006.01)

(52) U.S. Cl.
CPC ..... *H01Q 15/0086* (2013.01)

(58) Field of Classification Search
USPC ..... 343/702, 700 MS, 745, 909
See application file for complete search history.

(56) References Cited

U.S. PATENT DOCUMENTS

| | | | | |
|---|---|---|---|---|
| 6,362,789 | B1 | 3/2002 | Trumbull et al. | |
| 6,414,637 | B2 | 7/2002 | Keilen | |
| 6,515,627 | B2 | 2/2003 | Lopez et al. | |
| 7,253,780 | B2 | 8/2007 | Sievenpiper | |
| 7,592,957 | B2 | 9/2009 | Achour et al. | |
| 7,764,232 | B2 * | 7/2010 | Achour | H01Q 21/065 343/700 MS |
| 7,847,739 | B2 | 12/2010 | Achour et al. | |
| 7,855,696 | B2 | 12/2010 | Gummalla et al. | |
| 7,911,386 | B1 | 3/2011 | Itoh et al. | |
| 8,063,839 | B2 | 11/2011 | Ansari et al. | |
| 8,299,967 | B2 | 10/2012 | Xu et al. | |
| 2002/0130734 | A1 * | 9/2002 | Liang | H01P 1/2039 333/134 |
| 2004/0066251 | A1 | 4/2004 | Eleftheriades et al. | |
| 2005/0001769 | A1 | 1/2005 | Qi et al. | |
| 2007/0176827 | A1 | 8/2007 | Itoh et al. | |
| 2009/0128446 | A1 | 5/2009 | Gummalla et al. | |
| 2009/0135087 | A1 | 5/2009 | Gummalla et al. | |
| 2009/0245146 | A1 | 10/2009 | Gummalla et al. | |
| 2010/0060544 | A1 * | 3/2010 | Penev | H01Q 1/38 343/876 |
| 2010/0073254 | A1 | 3/2010 | Lee et al. | |

(Continued)

FOREIGN PATENT DOCUMENTS

| | | | |
|---|---|---|---|
| CN | 101436713 | A | 5/2009 |
| CN | 101447602 | A | 6/2009 |

OTHER PUBLICATIONS

Extended European Search Report for European Application No. 13163154.1, mailed Jun. 6, 2013.

(Continued)

*Primary Examiner* — Hoang V Nguyen
*Assistant Examiner* — Hai Tran

(57) ABSTRACT

An antenna for a wireless device includes a low band left-handed (LBLH) mode element and a low band right-handed (LBRH) mode element both operable in a low frequency bandwidth and a high band left-handed (HBLH) mode element and a high band right-handed (HBRH) mode element both operable in a high frequency bandwidth. The LBLH mode element is capacitively coupled to a feed of the antenna and is inductively coupled to a ground of the antenna. The LBRH mode element is electrically coupled to the feed of the antenna. The HBLH mode element is capacitively coupled to the feed of the antenna and is inductively coupled to the ground of the antenna. The HBRH mode element is electrically coupled to the feed of the antenna. At least one tuning element is operatively coupled to at least one of the mode elements.

23 Claims, 9 Drawing Sheets

(56) References Cited

U.S. PATENT DOCUMENTS

| | | | | |
|---|---|---|---|---|
| 2010/0109971 | A2 | 5/2010 | Gummalla et al. | |
| 2010/0123635 | A1* | 5/2010 | Lopez | H01Q 1/38 343/722 |
| 2012/0329524 | A1 | 12/2012 | Kent et al. | |

OTHER PUBLICATIONS

Caloz and Itoh, *Electromagnetic Metamaterials: Transmission Line Theory and Microwave Applications*, John Wiley & Sons (2006). (in 3 .pdf parts).

Itoh, T., "Invited Paper: Prospects for Metamaterials," Electronics Letters, 40(16); 972-973, Aug. 2004.

Lai A. et al., "Infinite Wavelength Resonant Antennas with Monopolar Radiation Pattern Based on Period Structures," IEEE Transactions on Antennas and Propagation, vol. 55(3), Mar. 2007, pp. 868-876.

Wu, Chien-Hung et al., "A Novel Small Planar Antenna Utilizing Cascaded Right/Left-Handed Transmission Lines," IEE Antennas and Propagation Society International Symposium 2007, Jun. 9-15, 2007, Honolulu, HI USA, Jun. 2007, pp. 1889-1892.

Lim S. et al., "Metamaterial-Based Electronically Controlled Transmission-Line Structure as a Novel Leaky-Wave Antenna with Tunable Radiation Angel and Beamwidth," IEEE Trnasactions on Microwave Theory and Techniques, vol. 52(12), Dec. 2004, pp. 2678-2690.

Chinese counterpart (201310125022.6) Office Action dated Jan. 13, 2015 2013.

California Eastern Laboratories (CEL), Data Sheet—CMOS Integrated Circuit μPD5713TK, "Wide Band SPDT Switch", Doc. No. PU1627EJ01 V0DS (1st edition), pp. 1-10, Sep. 2006.

* cited by examiner

ANTENNA FOR WIRELESS DEVICE

BACKGROUND OF THE INVENTION

The subject matter herein relates generally to antennas for wireless devices.

Wireless devices or wireless communication devices have use in many applications including telecommunications, computers and other applications. Examples of wireless devices include mobile phones, tablets, notebook computers, laptop computers, desktop computers, handsets, personal digital assistants (PDAs), a wireless access point (AP) such as a WiFi router, a base station in a wireless network, a wireless communication USB dongle or card (e.g., PCI Express card or PCMCIA card) for computers, and other devices. The wireless devices include antennas that allow for wireless communication with the device. Several antenna characteristics are usually considered in selecting an antenna for a wireless device, including the size, voltage standing wave ratio (VSWR), gain, bandwidth, and the radiation pattern of the antenna.

Known antennas for wireless devices have several disadvantages, such as limited bandwidth, large size, interference from a user's hand and/or head, and the like. Some known antennas for wireless devices address some of the antenna problems using composite right and left handed (CRLH) metamaterials for the antennas. For example, U.S. Pat. No. 7,764,232 to Achour, the subject matter of which is incorporated by reference in its entirety, describes antennas using CRLH metamaterial structures. Such antennas have expanded bandwidth to cover broader frequency ranges, but still run into bandwidth limitations.

It is desirable with systems today to use wireless devices that operate in multiple frequency bands simultaneously or to use wireless devices that effectively operate in specific radio bands and are able to remotely select such bands for different networks. Known antennas for wireless devices are not able to effectively address these needs, at least in part due to bandwidth limitations.

A need remains for an antenna that effectively operates in a broad frequency bandwidth while having a small physical antenna size.

BRIEF DESCRIPTION OF THE INVENTION

In one embodiment, an antenna for a wireless device is provided that includes a low band left-handed (LBLH) mode element operable in a low frequency bandwidth, a low band right-handed (LBRH) mode element operable in a low frequency bandwidth, a high band left-handed (HBLH) mode element operable in a high frequency bandwidth and a high band right-handed (HBRH) mode element operable in a high frequency bandwidth. The LBLH mode element is capacitively coupled to a feed of the antenna and is inductively coupled to a ground of the antenna. The LBRH mode element is electrically coupled to the feed of the antenna. The HBLH mode element is capacitively coupled to the feed of the antenna and is inductively coupled to the ground of the antenna. The HBRH mode element is electrically coupled to the feed of the antenna. At least one tuning element is operatively coupled to at least one of the mode elements.

Optionally, the tuning element may be a tunable capacitive element for active tuning of the corresponding mode element. The tuning element may include a ferroelectric capacitor having a voltage dependent dielectric constant to change a capacitance thereof. The tuning element may include a variable capacitive, a varactor diode, a MEMS switched capacitor, or an electronically switched capacitor. The tuning element may be an integral part of the corresponding mode element.

Optionally, the antenna may include an antenna circuit board having discrete circuit traces defining the mode elements. The tuning element may be terminated to the circuit trace(s) of the corresponding mode element(s). The antenna circuit board may include a power circuit electrically connected to the tuning element, where voltage from the power circuit changes a capacitance of the tuning element. The tuning element may be mounted to the antenna circuit board in series with the circuit traces of the corresponding mode elements. The tuning element may be mounted to the antenna circuit board in a shunt between the corresponding circuit traces and the ground. The tuning element may include a series capacitor mounted to the antenna circuit board in series with the circuit traces of the corresponding mode elements and an inductive trace in parallel with the series capacitor. The series capacitor may be a variable capacitor. Optionally, the tuning element may be operatively coupled to at least two of the mode elements, where the tuning element may provide matched tuning for the corresponding mode elements.

Optionally, the circuit trace defining the LBLH mode element may include a first cell and a first ground trace extending between the first cell and the ground. The circuit trace defining the LBRH mode element may include a meandering trace. The circuit trace defining the HBLH mode element may include a second cell and a second ground trace extending between the second cell and the ground. The circuit trace defining the HBRH mode element may include a feed trace directly connected to the feed of the antenna. The first cell may be capacitively coupled to the feed trace and the first ground trace may be inductively loaded. The meandering trace may tap into the feed trace. The second cell may be capacitively coupled to the feed trace and the second ground trace may be inductively loaded.

Optionally, the tuning element may be mounted to the antenna circuit board in series with the first ground trace, the second ground trace, the meandering trace, or the feed trace. The tuning element may be mounted to the circuit board and shunted between the ground and the first ground trace, the meandering trace or the feed trace. The tuning element may be mounted to the antenna circuit board and electrically connected between the feed trace and at least one of the first cell, the second cell, and the meandering trace.

In another embodiment, an antenna for a wireless device is provided including a feed, a ground, an antenna circuit board and a tuning element on the antenna circuit board. The antenna circuit board includes at least one left-handed mode element and at least one right-handed mode element. The at least one right-handed mode element is electrically coupled to the feed. The at least one left-handed mode element is capacitively coupled to the feed. The at least one left-handed mode element is inductively coupled to the ground. The tuning element is operatively coupled to the at least one left-handed mode element and/or the at least one right-handed mode element.

DETAILED DESCRIPTION OF SPECIFIC EMBODIMENTS OF THE INVENTION

Figure 1:
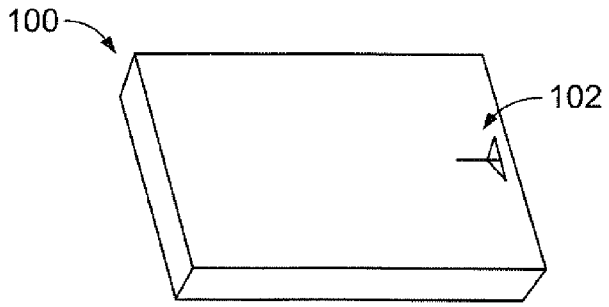
FIG. 1 illustrates a wireless device formed in accordance with an exemplary embodiment.

FIG. 1 illustrates a wireless device 100 formed in accordance with an exemplary embodiment. The wireless device 100 includes an antenna 102. The wireless device 100 may be used in a telecommunications application, a computer application or other applications. The wireless device 100 may be a mobile phone, a tablet, a notebook computer, a laptop computer, a desktop computer, a handset, a PDA, a wireless access point (AP) such as a WiFi router, a base station in a wireless network, a wireless communication USB dongle or card (e.g., PCI Express card or PCMCIA card) for a computer, or another type of wireless device. The antenna 102 allows for wireless communication to and/or from the wireless device 100.

In an exemplary embodiment, the antenna 102 includes both right handed mode antenna elements and left handed mode antenna elements. The right handed mode antenna elements have electromagnetic wave propagation that obeys the right handed rule for the electrical field, the magnetic field, and the wave vector. The phase velocity direction is the same as the direction of the signal energy propagation (group velocity) and the refractive index is a positive number. The left handed mode antenna elements are manufactured from a metamaterial structure that exhibits a negative refractive index where the phase velocity direction is opposite to the direction of the signal energy propagation. The relative directions of the vector fields follow the left handed rule.

The antenna 102 may be manufactured from a metamaterial structure that is a mixture of left handed metamaterials and right handed metamaterials to define a combined structure that behaves like a left handed metamaterial structure at low frequencies and a right handed material at high frequencies. The antenna structure exhibits both left hand and right hand electromagnetic modes of propagation, which may depend on the frequency of operation. Designs and properties of various metamaterials are described in U.S. Pat. No. 7,764,232 to Achour, the subject matter of which is incorporated by reference in its entirety.

The structure of the antenna 102 can be structured and engineered to exhibit electromagnetic properties that are tailored for specific applications and can be used in applications where the antennas operate in multiple frequency bands simultaneously. The structure of the antenna 102 can be structured and engineered to effectively operate in specific radio bands. The structure of the antenna 102 can be structured and engineered to remotely select specific radio bands for different networks. The structure of the antenna 102 can be structured and engineered to have a small physical antenna size while effectively operating in a broad frequency bandwidth. The structure of the antenna 102 can be structured and engineered to dynamically tune the antenna within one or more frequency bands.

Figure 2:
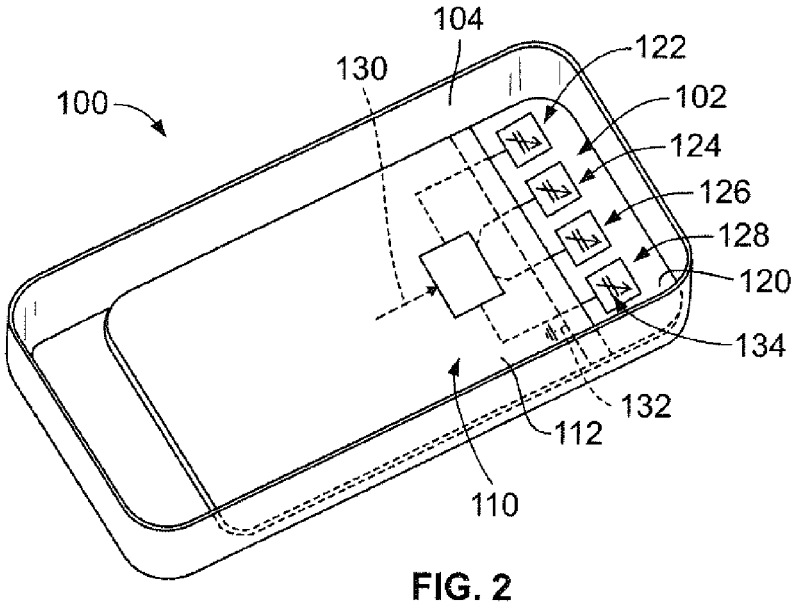
FIG. 2 illustrates a portion of the wireless device.

FIG. 2 illustrates a portion of the wireless device 100 showing a portion of a housing 104 with electronic components 110 in the housing 104. The electronic components 110 are used to operate the wireless device 100. In the illustrated embodiment, the electronic components 110 include a main circuit board 112 and the antenna 102. Other electronic components may be included to operate the wireless device 100, such as processors, batteries, controllers, inputs, outputs, displays, speakers, and the like.

The antenna 102 includes an antenna circuit board 120 having a plurality of antenna elements 122-128 thereon. The antenna 102 defines a combined left hand/right hand antenna. The antenna 102 includes a plurality of mode elements that are operable in different frequency bandwidths, such as different low band frequencies and different high band frequencies.

In the illustrated embodiment, the antenna 102 includes a low band left handed (LBLH) mode element 122, a low band right handed (LBRH) mode element 124, a high band left handed (HBLH) mode element 126, and a high band right handed (HBRH) mode element 128. Any of such mode elements may be referred to individually as a "mode element" and any combination thereof may be referred to together as "mode elements".

The mode elements 122-128 and electronic components 110 are represented schematically in FIG. 2. One or more of the mode elements 122-128 may be electrically connected to the main circuit board 112. For example, one or more of the mode elements 122-128 may be electrically connected to a feed 130 on the main circuit board 112. One or more of the mode elements 122-128 may be electrically connected to a ground 132 on the main circuit board 112.

In an exemplary embodiment, at least one of the mode elements 122-128 includes a tuning element 134 associated therewith. In the illustrated embodiment, each of the mode elements 122-128 have a tuning element 134 associated therewith. In alternative embodiments, less than all of the mode elements 122-128 may have a tuning element 134 associated therewith, for example, only one of the mode elements 122-128 may have a tuning element 134. Optionally, the tuning elements 134 may be connected to more than mode element 122-128.

In the illustrated embodiment, the tuning elements 134 are represented by variable capacitors. Other types of tuning elements may be used in alternative embodiments. For example, the tuning element 134 may be a ferroelectric capacitor having a voltage dependent dielectric constant to change a capacitance thereof, such as a Barium Strontium Titanate (BST) capacitor. In other embodiments, the tuning element 134 may be a varactor diode, a MEMS switched capacitor, an electronically switched capacitor, and the like. Other types of tuning elements may be used on alternative embodiments. The tuning elements 134 are used to dynamically affect the antenna characteristics of one or more of the mode elements 122-128. For example, the frequency, bandwidth, impedance, gain, loss, and the like of the mode element 122-128 may be tuned or adjusted by the tuning element 134.

The tuning elements 134 may be operably coupled to a controller or processor on the main circuit board 112 to control operation thereof. For example, the controller may adjust one or more characteristic of the tuning element 134 to affect the operation of the tuning element. Optionally, the tuning element 134 may be controlled by varying a voltage applied to the tuning element 134. The controller may control the voltage supplied to the tuning element 134 to control operation of the tuning element 134. The tuning of the tuning elements 134 may be electrically tuned via the controller in response to an internal program or one or more external signals, such as signals received by the antenna 102. Alternatively, the tuning elements 134 may be controlled by a manual operated switch, such as a switching device, on the main circuit board 112.

In an exemplary embodiment, the mode elements 122-128 are defined by circuits on the antenna circuit board 120. The circuits may be routed on one or more layers of the antenna circuit board 120. In alternative embodiments, the mode elements 122-128 may include or may be separate components that are mounted to the antenna circuit board 120. The tuning elements 134 may be defined by circuits formed on the antenna circuit board 120. Alternatively, the tuning elements 134 may be, or include, separate components mounted to the antenna circuit board 120. Optionally, the antenna circuit board 120 may be a FR4 board received within the housing 104. Alternatively, the antenna circuit board 120 may be defined by a flex circuit wrapped around a 3D component received in the housing 104. In other alternative embodiments, the antenna circuit board 120 may be defined by the structure of the housing, such as the molded plastic defining the housing or case. The antenna elements may be formed on one or more surfaces of the housing 104. The antenna elements may be formed on the interior or the exterior of the housing 104.

Figure 3:
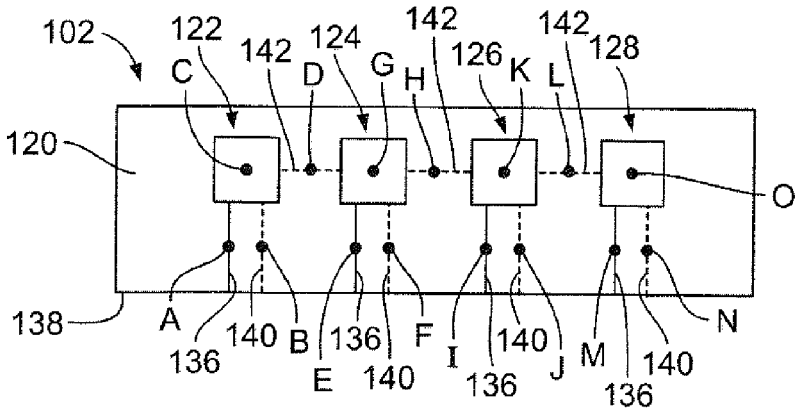
FIG. 3 is a schematic illustration of an antenna for the wireless device.

FIG. 3 is a schematic illustration of the antenna 102. The mode elements 122-128 are shown on the antenna circuit board 120. The mode elements 122-128 have at least one circuit trace 136. Optionally, the circuit traces 136 may extend from an edge 138 of the antenna circuit board 120. Other embodiments may not have the circuit traces 136 leading from the edge 138, but may be provided along other portions of the antenna circuit board 120.

The mode elements 122-128 are shown to have optional circuit traces 140 (shown in phantom) extending between the mode elements 122-128 and the edge 138. Such circuit traces 140 are optional and may not be used in some designs. Optional circuit traces 142 (shown in phantom) extend between various mode elements 122-128. Such circuit traces 142 are optional and may not be used in some designs.

Various locations for placement of the tuning elements 134 are shown in FIG. 3. For example, for tuning effect on the LBLH mode element 122, a tuning element 134 may be placed 1) at location A in series along the circuit trace 136; 2) at location B along a shunt defined by the circuit trace 140; 3) at location C on the LBLH mode element 122; and/or 4) at location D on the connecting circuit trace 142 between the LBLH mode element 122 and the LBRH mode element 124 (or other mode elements).

For tuning effect on the LBRH mode element 124, for example, a tuning element 134 may be placed 1) at location E in series along the circuit trace 136; 2) at location F along a shunt defined by the circuit trace 140; 3) at location G on the LBRH mode element 124; 4) at location D on the connecting circuit trace 142 between the LBLH mode element 122 and the LBRH mode element 124; and/or 5) at location H on the connecting circuit trace 142 between the LBRH mode element 124 and the HBLH mode element 124 (or other mode elements).

For tuning effect on the HBLH mode element 126, for example, a tuning element 134 may be placed 1) at location I in series along the circuit trace 136; 2) at location J along a shunt defined by the circuit trace 140; 3) at location K on the HBLH mode element 126; 4) at location Hon the connecting circuit trace 142 between the HBLH mode element 126 and the LBRH mode element 124; and/or 5) at location L on the connecting circuit trace 142 between the HBLH mode element 126 and the HBRH mode element 128 (or other mode elements).

For tuning effect on the HBRH mode element 128, for example, a tuning element 134 may be placed 1) at location M in series along the circuit trace 136; 2) at location N along a shunt defined by the circuit trace 140; 3) at location O on the HBRH mode element 128; and/or 4) at location L on the connecting circuit trace 142 between the HBLH mode element 126 and the HBRH mode element 128 (or other mode elements).

Other mode elements may be provided in other embodiments. The tuning elements 134 may have other placements in alternative embodiments. The tuning elements 134 are used to dynamically affect the antenna characteristics of one or more of the mode elements 122-128. For example, the resonant frequency of the mode element may be tuned or adjusted by the tuning element 134. The tuning element 134 may be used to match the impedance or other characteristic of the mode element 122-128 with another mode element 122-128 or other electrical component of the antenna 102.

Figure 4:
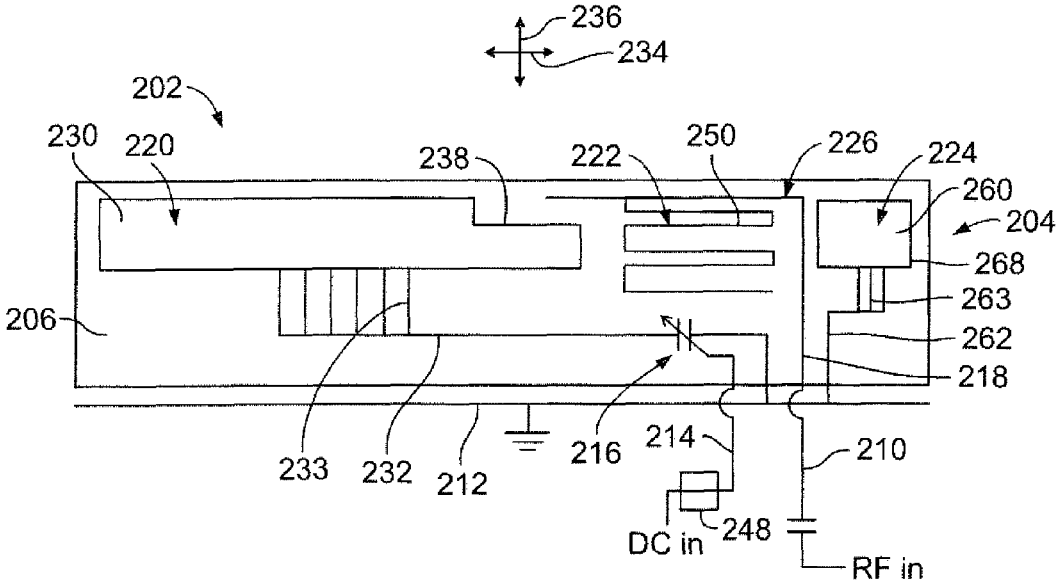
FIG. 4 illustrates an antenna for the wireless device.

FIG. 4 illustrates an antenna 202 that may be used with the wireless device 100 (shown in FIG. 1) in lieu of the antenna 102. The antenna 202 includes a particular arrangement of mode elements 204 formed by circuits on an antenna circuit board 206. The size, shape, and positioning of the mode elements 204 are designed for a particular application and may be changed to provide different characteristic for the antenna 202, such as being designed to operate at different frequencies. The different mode elements 204 allow the antenna 202 to be used in different frequency bands. The antenna 202 has a wide bandwidth by use of the multiple mode elements. The antenna 202 uses both right hand and left hand electromagnetic modes of propagation to operate efficiently at multiple frequency bands. The antenna 202 is also designed to tune the mode elements 204 for more efficient operation.

A feed 210 is provided that feeds radio waves to the antenna 202 and/or collects the incoming radio waves and converts them to electric currents to transmit them to a receiver or other component on the main circuit board 112 (shown in FIG. 2). A ground 212 is provided. Optionally, the ground 212 may be part of the main circuit board 112. Alternatively, the ground 212 may be part of the antenna 202 and connected to a ground on the main circuit board 112 or other component. The ground 212 may be part of another electronic element of the wireless device 100 in other alternative embodiments. A power supply 214 is connected to one or more components of the antenna 202.

The antenna 202 includes a tuning element 216 coupled to one of the antenna mode elements 204. Optionally, multiple tuning elements 216 may be provided coupled to any of the mode elements 204. The antenna 202 includes a feed line 218 on the antenna circuit board 206. The feed line 218 is a conductive trace on the antenna circuit board 206. The feed line 218 is connected to the feed 210 at or near an edge of the antenna circuit board 206. The position of the mode elements 204 with respect to the feed line 218 affects the antenna characteristics of the mode elements 204.

In the illustrated embodiment, the antenna 202 includes four mode elements 204, however more or less antenna mode elements 204 may be utilized in alternative embodiments. The antenna 202 includes an LBLH mode element 220, an LBRH mode element 222, an HBLH mode element 224 and an HBRH mode element 226. In an exemplary embodiment, the HBRH mode element 226 is defined by the feed line 218. The feed line 218 extends along the antenna circuit board 206 in proximity to the LBLH mode element 220, LBRH mode element 222, and/or the HBLH mode element 224. A length of the feed line 218 may control antenna characteristics of the HBRH mode element 226.

The LBLH mode element 220 includes a cell 230 and a ground trace 232 connecting the cell 230 to the ground 212. The cell 230 may have any size and shape. The cell 230 is defined by a pad on the antenna circuit board 206. The cell 230 is relatively larger than then ground trace 232. The size and shape of the cell 230 controls the antenna characteristics of the LBLH mode element 220.

The cell 230 has a length defined along a longitudinal axis 234 of the antenna circuit board 206 and a width defined along a lateral axis 236 of the antenna circuit board 206. The cell 230 is peripherally surrounded by an edge 238. The edge 238 may define a polygon. The cell 230 has a significantly greater surface area than the ground trace 232. For example, the cell 230 is wider than the ground trace 232. Optionally, the width and/or the length of the cell 230 may be non-uniform. For example, the cell 230 may include a notched area(s) that provide a space(s) for other circuits of the antenna 202. In the illustrated embodiment, the cell 230 is the largest circuit structure on the antenna circuit board 206. The cell 230 may cover approximately 20% or more of the surface area of the antenna circuit board 206.

A portion of the cell 230 is located in close proximity to the feed line 218. The feed line 218 is capacitively coupled to the cell 230 at such portion. The distance between the cell 230 and the feed line 218 controls the amount of capacitive coupling therebetween. A length of the interface between the feed line and the cell 230 controls the amount of capacitive coupling therebetween. The amount of capacitive coupling affects the antenna characteristics of the LBLH mode element 220.

The ground trace 232 extends between the cell 230 and the ground 212. The ground trace 232 provides inductive coupling and/or inductive loading for the cell 230. The ground trace 232 may tap into the cell 230 at multiple locations with multiple bridges 233. The amount of inductive loading may be controlled by the number of taps between the ground trace 232 and the cell 230. The inductive loading and capacitive coupling of the LBLH mode element 220 provide the left hand mode of propagation for the LBLH mode element 220.

In an exemplary embodiment, the ground 212 may be provided at an edge 240 of the antenna circuit board 206. The ground trace 232 may be connected to the ground 212 at the edge 240. Optionally, the ground 212 may be provided on the antenna circuit board 206, such as on a bottom or interior layer of the antenna circuit board 206. The ground trace 232 may be connected to the ground 212 by a via extending through the antenna circuit board 206.

In an exemplary embodiment, the ground trace 232 is routed along the antenna circuit board 206 to a location near the feed 210 and corresponding feed line 218 on the antenna circuit board 206. The proximity of the ground trace 232 to the feed 210 and/or feed line 218 controls antenna characteristics of the LBLH mode element 220. For example, the frequency of the LBLH mode element 220 may be controlled by the proximity of the ground trace 232 to the feed 210 and/or the feed line 218.

The location where the ground trace 232 taps into the cell 230 controls characteristics of the LBLH mode element 220. For example, the frequency may be controlled by the location of the bridges 233 and the taps of the ground trace 232 to the cell 230. The number of taps and bridges 233 from the ground trace 232 to the cell 230 may also control the antenna characteristics of the LBLH mode element 220.

In an exemplary embodiment, the tuning element 216 is coupled to the LBLH mode element 220. In the illustrated embodiment, the tuning element 216 is a variable capacitor provided in series with the ground trace 232. The tuning element 216 is provided in-line with the ground trace 232. For example, the ground trace 232 is broken along the trace and the tuning element 216 is connected between the two discontinuous segments of the ground trace 232. The tuning element 216 may be located anywhere along the ground trace 232. The tuning element 216 may be positioned proximate to the ground 212. The tuning element 216 may be positioned proximate to the cell 230. The tuning element 216 may be coupled to the cell 230 rather than, or in addition to, the ground trace 232. The location of the tuning element 216 along the ground trace 232 may control antenna characteristics of the LBLH mode element 220.

In an exemplary embodiment, the tuning element 216 is electrically connected to the power supply 214. The power supply may be controlled by a controller 248 on the main circuit board, or elsewhere. The controller 248 in may vary the voltage supplied in response to an internal program or in response to one or more external signals received by the wireless device 100, such as signals received by the antenna 102. Alternatively, the controller 248 may vary the power supply by a mechanically operated switch, such as a switching device. Voltage from the power supply 214 may affect a characteristic or operate the tuning element 216 to tune the LBLH mode element 220. For example, the capacitance of the tuning element 216 may be varied by the voltage applied to the tuning element 216. Varying the capacitance of the tuning element 216 affects one or more antenna characteristic of the LBLH mode element 220, such as the impedance thereof, to tune the frequency of the LBLH mode element 220.

The LBRH mode element 222 is defined by a meandering trace 250 that taps into the feed line 218. The location(s) where the meandering trace 250 taps into the feed line 218 may control antenna characteristics of the LBRH mode element 222, such as a frequency of the LBRH mode element 222. The proximity of the meandering trace 250 to the cell 230 and/or the ground trace 232 may affect antenna characteristics of the LBRH mode element 222, such as the frequency LBRH mode element 222. The length of the meandering trace 250 may affect the antenna characteristics of the LBRH mode element 222. The number of meandered sections may affect the antenna characteristics of the LBRH mode element 222. The proximity of the meandering sections to one another may affect the antenna characteristics of the LBRH mode element 222. Optionally, a tuning element (not shown) may be electrically connected to the meandering trace 250 to tune the LBRH mode element 222.

The HBLH mode element 224 includes a cell 260 and a ground trace 262 connecting the cell 260 to the ground 212. A tuning element (not shown) may be coupled to the HBLH mode element 224 to tune the HBLH mode element 224.

The cell 260 may have any size and shape. The cell 260 is defined by a pad on the antenna circuit board 206. The cell 260 is relatively larger than then ground trace 262. The size and shape of the cell 260 controls antenna characteristics of the HBLH mode element 224.

The cell 260 has a length defined along the longitudinal axis 234 of the antenna circuit board 206 and a width defined along the lateral axis 236 of the antenna circuit board 206. The cell 260 is peripherally surrounded by an edge 268. The edge 268 may define a polygon. The cell 260 has a significantly greater surface area than the ground trace 262. For example, the cell 260 is wider than the ground trace 262. Optionally, the width and/or the length of the cell 260 may be non-uniform. In the illustrated embodiment, the cell 260 is a large circuit structure on the antenna circuit board 206. The cell 260 may cover approximately 10% or more of the surface area of the antenna circuit board 206.

A portion of the cell 260 is located in close proximity to the feed line 218. The feed line 218 is capacitively coupled to the cell 260 at such portion. The distance between the cell 260 and the feed line 218 controls the amount of capacitive coupling therebetween. A length of the interface between the feed line 218 and the cell 260 controls the amount of capacitive coupling therebetween. The amount of capacitive coupling affects the antenna characteristics of the HBLH mode element 224.

The ground trace 262 extends between the cell 260 and the ground 212. The ground trace 262 provides inductive coupling and/or inductive loading for the cell 260. The ground trace 262 may tap into the cell 260 at multiple locations with multiple bridges 263. The amount of inductive loading may be controlled by the number of taps between the ground trace 262 and the cell 260. The inductive loading and capacitive coupling of the HBLH mode element 224 provide the left hand mode of propagation for the HBLH mode element 224.

In an exemplary embodiment, the ground trace 262 is routed along the antenna circuit board 206 to a location near the feed 210 and corresponding feed line 218 on the antenna circuit board 206. The proximity of the ground trace 262 to the feed 210 and/or feed line 218 controls antenna characteristics of the HBLH mode element 224. For example, the frequency of the HBLH mode element 224 may be controlled by the proximity of the ground trace 262 to the feed 210 and/or the feed line 218.

The location where the ground trace 262 taps into the cell 260 controls characteristics of the HBLH mode element 224. For example, the frequency may be controlled by the location of the bridges 263 and the taps of the ground trace 262 to the cell 260. The number of taps and bridges 263 from the ground trace 262 to the cell 260 may also control the antenna characteristics of the HBLH mode element 224.

Figure 5:
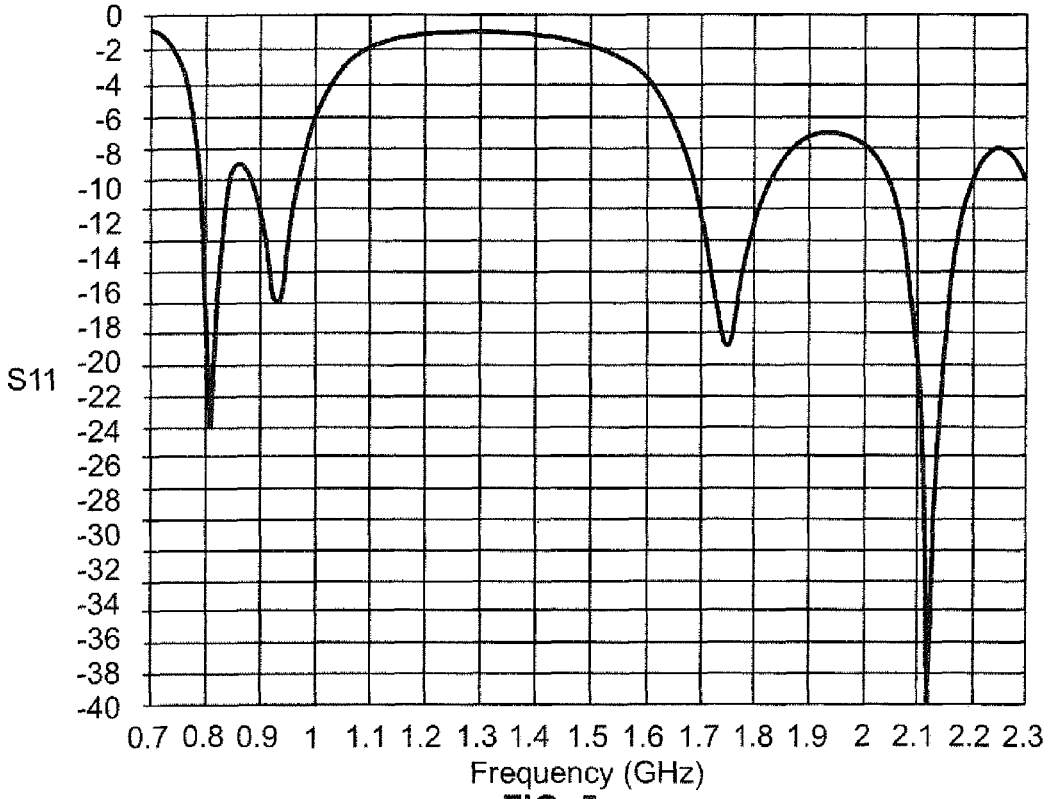
FIG. 5 illustrates a HFSS simulation of the antenna shown in FIG. 4.

FIG. 5 illustrates a HFSS simulation of the antenna 202 showing $S_{11}$ values at various frequencies. The antenna 202 has good performance at multiple frequency bands corresponding to the different mode elements 204. In the illustrated embodiment, the LBLH mode element 220 resonates at the lowest frequency band (e.g. approximately 810 MHz), the LBRH mode element 222 resonates at the second lowest frequency band (e.g. approximately 925 MHz), the HBLH mode element 224 resonates at the second highest frequency band (e.g. approximately 1750 MHz) and the HBRH mode element 226 resonates at the highest frequency band (e.g. approximately 2110 MHz). The resonant frequencies of the mode elements 204 may be different by changing design characteristics of such mode elements 204 (e.g. size, shape, location, and the like). The lower bands are generally defined as being lower than 1000 MHz and the upper bands are generally defined as being higher than 1500 MHz, however some mode elements may be designed to operate at frequencies therebetween. The resonant frequencies of the mode elements 204 may be dynamically adjusted by the tuning element(s) 216.

Figure 6:
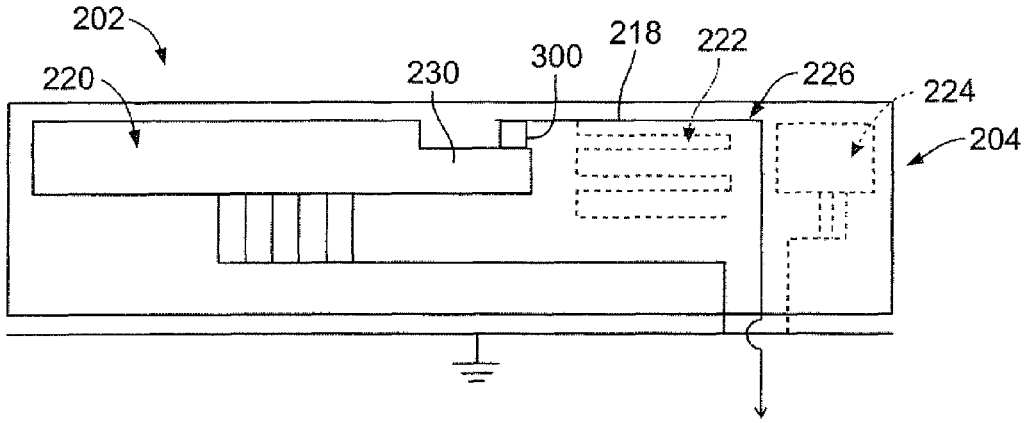
FIGS. 6-17 show the antenna with tuning elements coupled thereto.

FIG. 6 shows the antenna 202 with some of the mode elements 204 in phantom. A tuning element 300 is directly connected between the feed line 218 and the cell 230. The tuning element 300 is a match tuning element. The match tuning element 300 is used to match the LBLH and HBRH mode elements 220, 226 (or whichever mode elements 220-226 the match tuning element 300 is connected between) to a particular impedance, such as 50 Ohms.

The tuning element 300 may be a variable capacitor. The tuning element 300 may be used to match the LBLH and HBRH mode elements 220, 226 to accommodate for different environmental conditions of the antenna 202. For example, when the wireless device 100 (shown in FIG. 1) is held by a user such that the users hand/or head is proximate to the antenna 202, the electrical characteristics of the mode elements 204 may be affected. The tuning element 300 provides tuning between the LBLH and HBRH mode elements 220, 226 to achieve the target impedance. The tuning element 300 may be positioned between other mode elements, such as between the LBLH and LBRH mode elements 220, 222; between the LBRH and HBRH mode elements 222, 226; between the HBLH and HBRH mode elements 224, 226; or other combinations.

Figure 7:
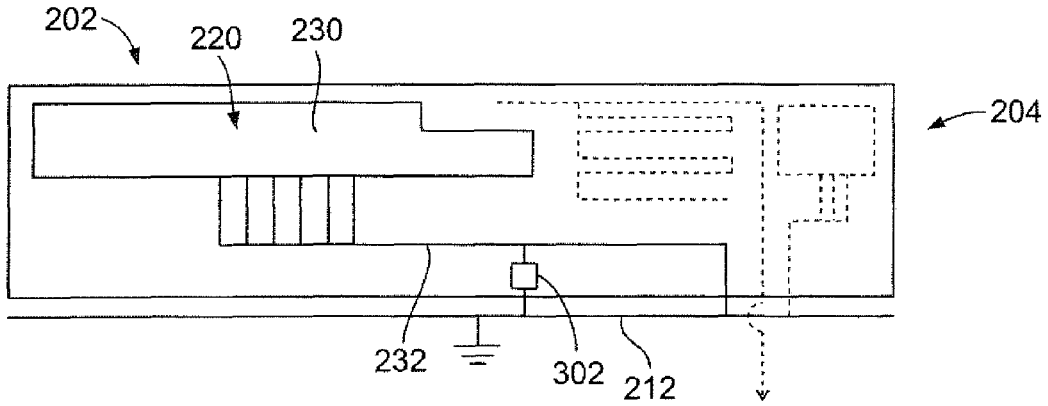

FIG. 7 illustrates the antenna 202 with some of the mode elements 204 in phantom. A tuning element 302 is positioned between the ground trace 232 and the ground 212. The tuning element 302 forms part of a shunt circuit for the LBLH mode element 220. The tuning element 302 defines a shunt tuning element. The ground trace 232 is shunted to the ground 212 by the tuning element 302. Optionally, the tuning element 302 may include a variable capacitor. The location of the tuning element 302 with respect to the ground trace 232 may affect the antenna characteristics of the LBLH mode element 220. For example, the proximity of the tuning element 302 to the tap end of the ground trace 232 where the ground trace 232 connects to the cell 230 may affect the antenna characteristics of the LBLH mode element 220. For example, shifting of the location of the tuning element 302 may change the resonant frequency of the LBLH mode element 220.

Figure 8:
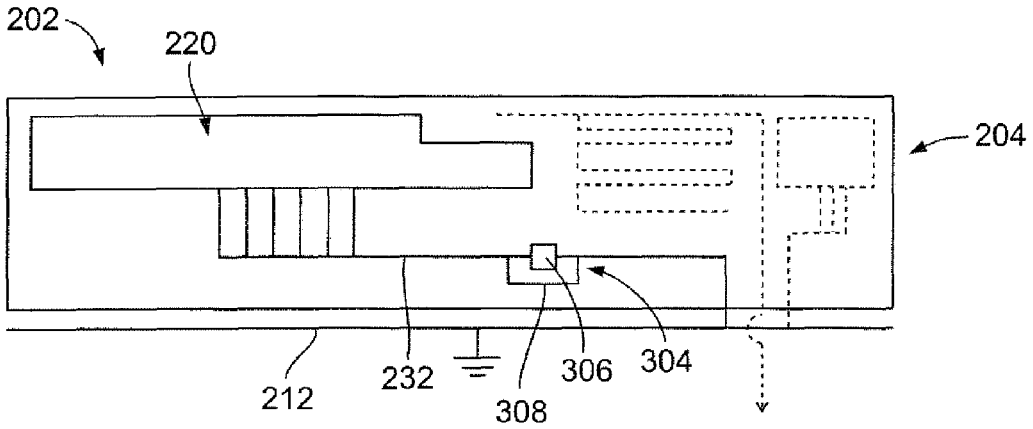

FIG. 8 illustrates the antenna 202 with some of the mode elements in phantom. A tuning element 304 is provided. The tuning element 304 includes a variable capacitor 306 coupled in series with the ground trace 232 and an inductive trace 308 by-passing the variable series capacitor 306. The inductive trace 308 is tuned to resonate with the variable series capacitor 306. The tuning element 304 defines a dual mode tuning element having both capacitive coupling and inductive coupling. The positioning of the tuning element 304 along the ground trace 232 may affect the antenna characteristics of the LBLH mode element 220. A length of the inductive trace 308 may affect the antenna characteristics of the LBLH mode element 220. Proximity of the inductive trace 308 to the variable series capacitor 306 may affect the antenna characteristics of the LBLH mode element 220. The location of the tuning element 304 along the ground trace 232 may affect the antenna characteristics of the LBLH mode element 220. For example, shifting of the location of the tuning element 304 may change the resonant frequency of the LBLH mode element 220.

Figure 9:
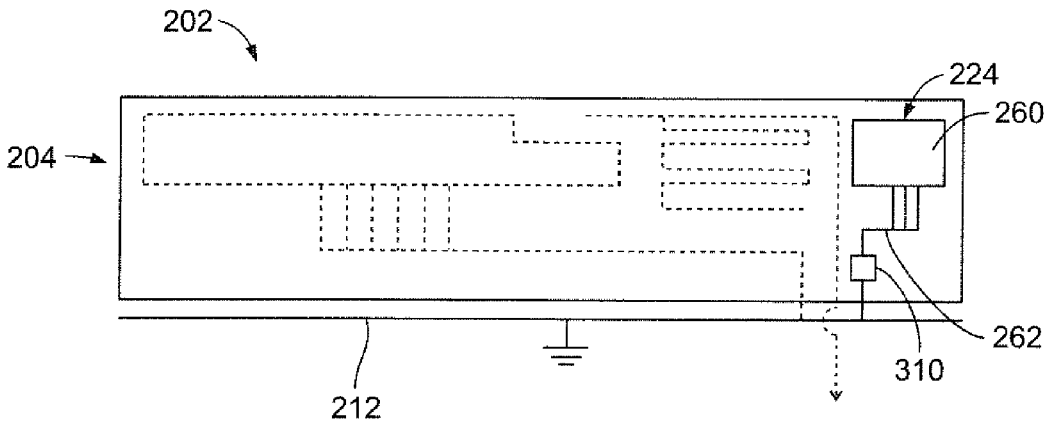

FIG. 9 illustrates the antenna 202 with some of the mode elements 204 in phantom. A tuning element 310 is associated with the HBLH mode element 224. The tuning element 310 is positioned in series with the ground trace 262. The tuning element 310 is a series tuning element. Optionally, the tuning element 310 may include a variable capacitor. The location of the tuning element 310 along the ground trace 262 may affect the antenna characteristics of the HBLH mode element 224. For example, the proximity of the tuning element 312 to the tap end of the ground trace 262 where the ground trace 262 connects to the cell 260 may affect the antenna characteristics of the HBLH mode element 224. For example, shifting of the location of the tuning element 310 may change the resonant frequency of the HBLH mode element 224.

Figure 10:
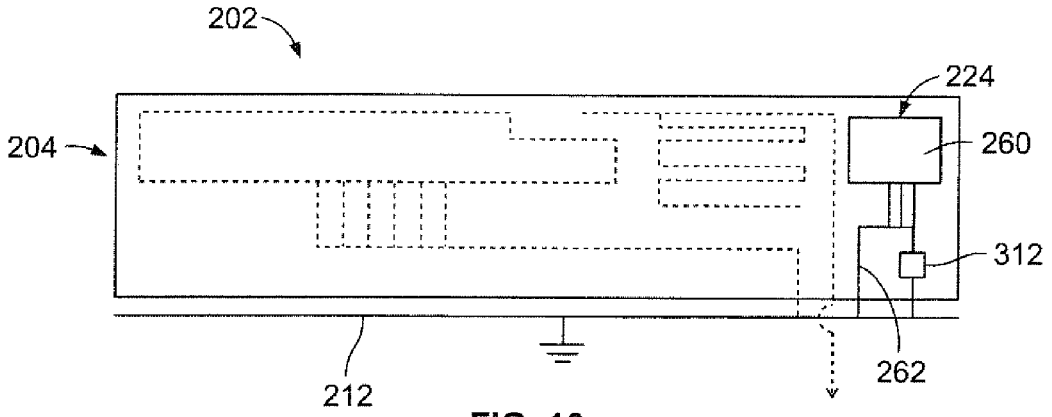

FIG. 10 illustrates the antenna 202 with some of the mode elements 204 in phantom. A tuning element 312 is associated with the HBLH mode element 224. The tuning element 312 is positioned between the ground trace 262 and the ground 212. The tuning element 312 forms part of a shunt circuit for the HBLH mode element 224. The tuning element 312 defines a shunt tuning element. The ground trace 262 is shunted to the ground 212 by the tuning element 312. Optionally, the tuning element 312 may include a variable capacitor. The location of the tuning element 312 with respect to the ground trace 262 may affect the antenna characteristics of the HBLH mode element 224. For example, the proximity of the tuning element 312 to the tap end of the ground trace 262 where the ground trace 262 connects to the cell 260 may affect the antenna characteristics of the HBLH mode element 224. For example, shifting of the location of the tuning element 312 may change the resonant frequency of the HBLH mode element 224.

Figure 11:
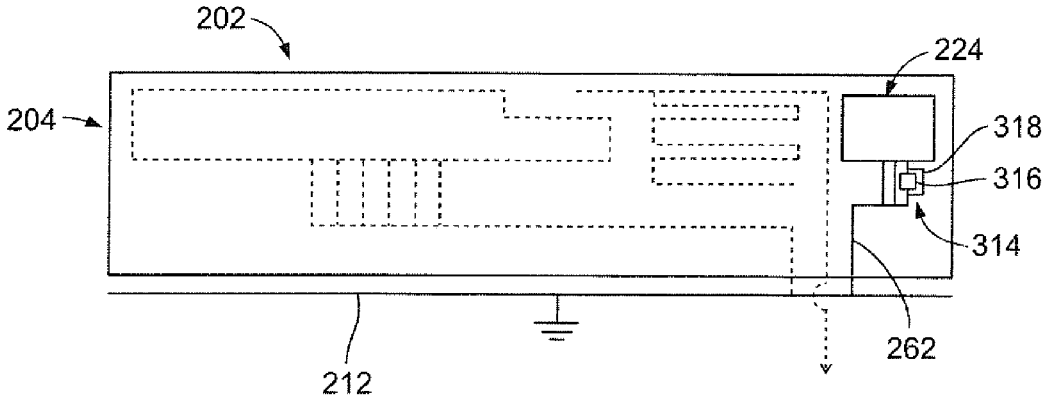

FIG. 11 illustrates the antenna 202 with some of the mode elements 204 in phantom. A tuning element 314 is associated with the HBLH mode element 224. The tuning element 314 includes a variable capacitor 316 coupled in series with the ground trace 262 and an inductive trace 318 by-passing the variable series capacitor 316. The inductive trace 318 is tuned to resonate with the variable series capacitor 316. The tuning element 314 defines a dual mode tuning element having both capacitive coupling and inductive coupling. The positioning of the tuning element 314 along the ground trace 262 may affect the antenna characteristics of the HBLH mode element 224. A length of the inductive trace 318 may affect the antenna characteristics of the HBLH mode element 224. Proximity of the inductive trace 318 to the variable series capacitor 316 may affect the antenna characteristics of the HBLH mode element 224. The location of the tuning element 314 along the ground trace 262 may affect the antenna characteristics of the HBLH mode element 224. For example, shifting of the location of the tuning element 314 may change the resonant frequency of the HBLH mode element 224.

Figure 12:
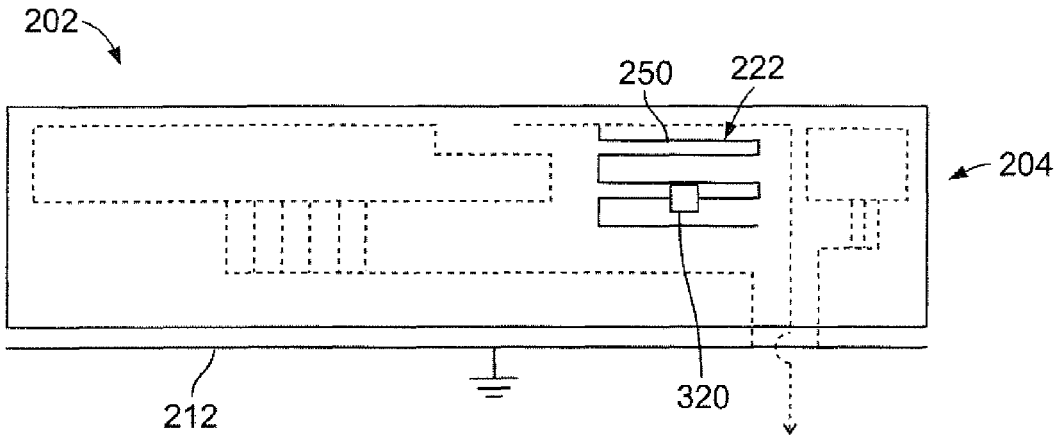

FIG. 12 illustrates the antenna 202 with some of the mode elements 204 in phantom. A tuning element 320 is associated with the LBRH mode element 222. The tuning element 320 is positioned in series with the meandering trace 250. The tuning element 320 is a series tuning element. Optionally, the tuning element 320 may include a variable capacitor. The location of the tuning element 320 along the meandering trace 250 may affect the antenna characteristics of the LBRH mode element 222. For example, the proximity of the tuning element 322 to the tap end of the meandering trace 250 where the meandering trace 250 connects to the feed line 218 may affect the antenna characteristics of the LBRH mode element 222. For example, shifting of the location of the tuning element 320 may change the resonant frequency of the LBRH mode element 222.

Figure 13:
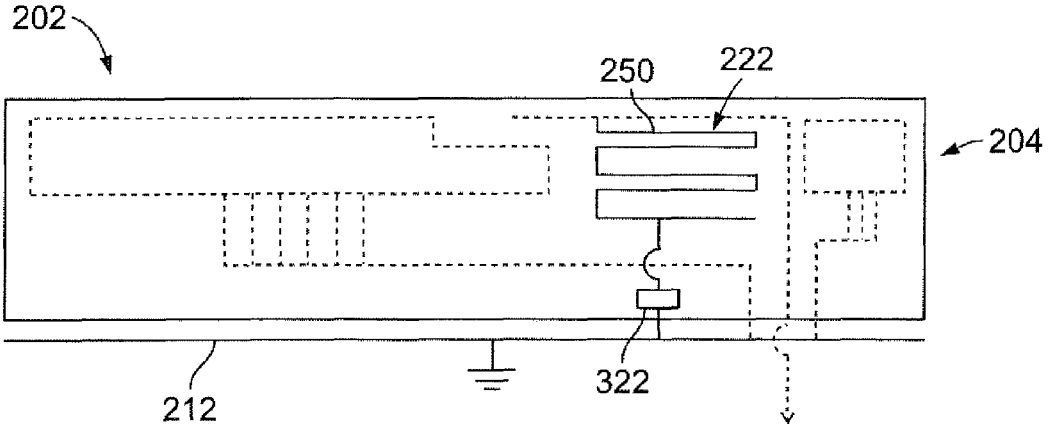

FIG. 13 illustrates the antenna 202 with some of the mode elements 204 in phantom. A tuning element 322 is associated with the LBRH mode element 222. The tuning element 322 is positioned between the meandering trace 250 and the ground 212. The tuning element 322 forms part of a shunt circuit for the LBRH mode element 222. The tuning element 322 defines a shunt tuning element. The meandering trace 250 is shunted to the ground 212 by the tuning element 322. Optionally, the tuning element 322 may include a variable capacitor. The location of the tuning element 322 with respect to the meandering trace 250 may affect the antenna characteristics of the LBRH mode element 222. For example, the proximity of the tuning element 322 to the tap end of the meandering trace 250 where the meandering trace 250 connects to the cell 260 may affect the antenna characteristics of the LBRH mode element 222. For example, shifting of the location of the tuning element 322 may change the resonant frequency of the LBRH mode element 222.

Figure 14:
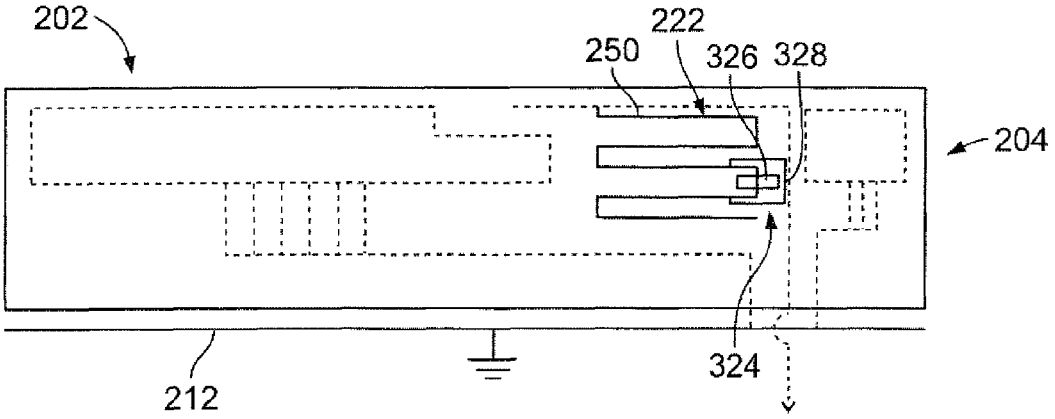

FIG. 14 illustrates the antenna 202 with some of the mode elements 204 in phantom. A tuning element 324 is associated with the LBRH mode element 222. The tuning element 324 includes a variable capacitor 326 coupled in series with the meandering trace 250 and an inductive trace 328 by-passing the variable series capacitor 326. The inductive trace 328 is tuned to resonate with the variable series capacitor 326. The tuning element 324 defines a dual mode tuning element having both capacitive coupling and inductive coupling. The positioning of the tuning element 324 along the meandering trace 250 may affect the antenna characteristics of the LBRH mode element 222. A length of the inductive trace 328 may affect the antenna characteristics of the LBRH mode element 222. Proximity of the inductive trace 328 to the variable series capacitor 326 may affect the antenna characteristics of the LBRH mode element 222. The location of the tuning element 324 along the meandering trace 250 may affect the antenna characteristics of the LBRH mode element 222. For example, shifting of the location of the tuning element 324 may change the resonant frequency of the LBRH mode element 222.

Figure 15:
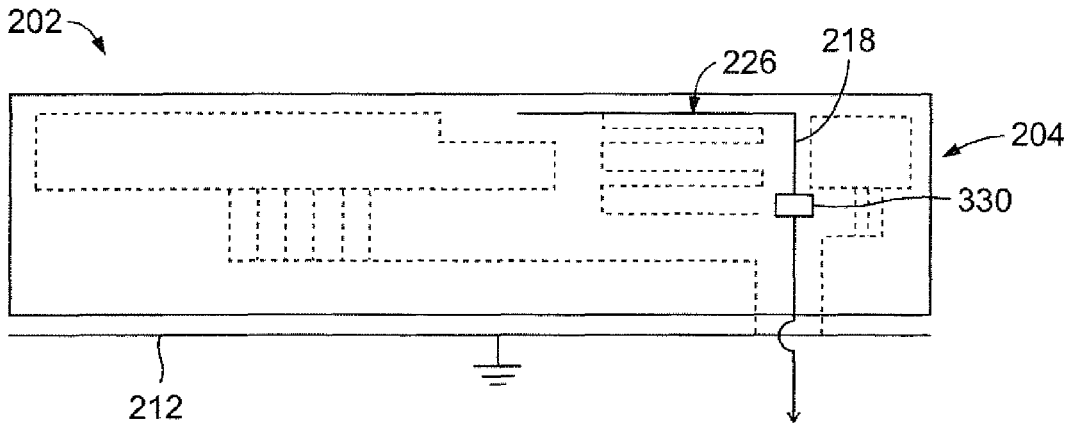

FIG. 15 illustrates the antenna 202 with some of the mode elements 204 in phantom. A tuning element 330 is associated with the HBRH mode element 226. The tuning element 330 is positioned in series with the feed line 218. The tuning element 330 is a series tuning element. Optionally, the tuning element 330 may include a variable capacitor. The location of the tuning element 330 along the feed line 218 may affect the antenna characteristics of the HBRH mode element 226. For example, the proximity of the tuning element 332 to the tap of the feed line 218 with the feed 210 may affect the antenna characteristics of the HBRH mode element 226. For example, shifting of the location of the tuning element 330 may change the resonant frequency of the HBRH mode element 226.

Figure 16:
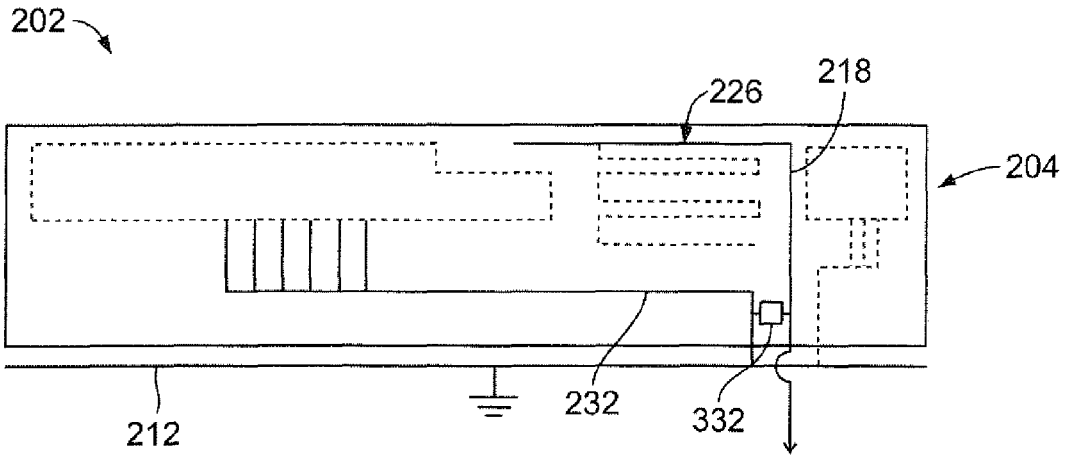

FIG. 16 illustrates the antenna 202 with some of the mode elements 204 in phantom. A tuning element 332 is associated with the HBRH mode element 226. The tuning element 332 is positioned between the feed line 218 and the ground 212, via the ground trace 232 which is connected to the ground 212. The tuning element 332 may be positioned between the feed line 218 and the ground trace 262 or directly between the feed line 218 and the ground 212 in alternative embodiments. The tuning element 332 forms part of a shunt circuit for the HBRH mode element 226. The tuning element 332 defines a shunt tuning element. The feed line 218 is shunted to the ground 212 by the tuning element 332. Optionally, the tuning element 332 may include a variable capacitor. The location of the tuning element 332 along the feed line 218 may affect the antenna characteristics of the HBRH mode element 226. For example, the proximity of the tuning element 332 to the end of the feed line 218 where the feed line 218 connects to the feed 210 may affect the antenna characteristics of the HBRH mode element 226. For example, shifting of the location of the tuning element 332 may change the resonant frequency of the HBRH mode element 226.

Figure 17:
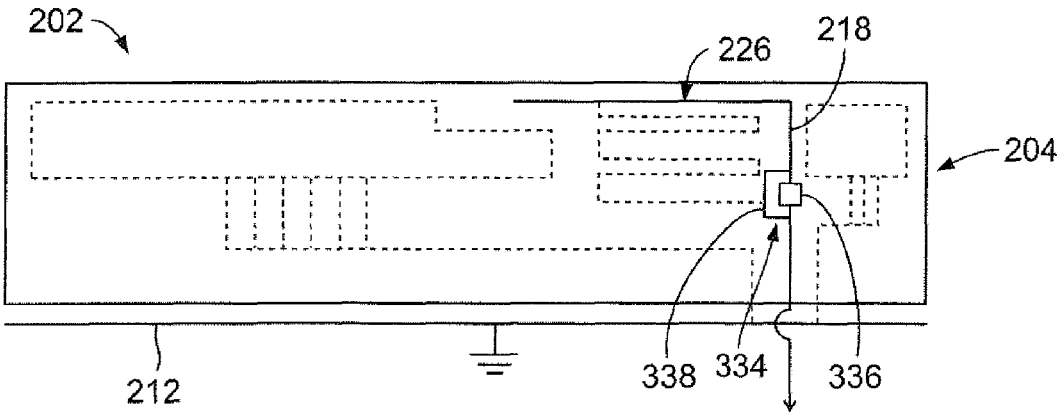

FIG. 17 illustrates the antenna 202 with some of the mode elements 204 in phantom. A tuning element 334 is associated with the HBRH mode element 226. The tuning element 334 includes a variable capacitor 336 coupled in series with the feed line 218 and an inductive trace 338 by-passing the variable series capacitor 336. The inductive trace 338 is tuned to resonate with the variable series capacitor 336. The tuning element 334 defines a dual mode tuning element having both capacitive coupling and inductive coupling. The positioning of the tuning element 334 along the feed line 218 may affect the antenna characteristics of the HBRH mode element 226. A length of the inductive trace 338 may affect the antenna characteristics of the HBRH mode element 226. Proximity of the inductive trace 338 to the variable series capacitor 336 may affect the antenna characteristics of the HBRH mode element 226. The location of the tuning element 334 along the feed line 218 may affect the antenna characteristics of the HBRH mode element 226. For example, shifting of the location of the tuning element 334 may change the resonant frequency of the HBRH mode element 226.

Figure 18:
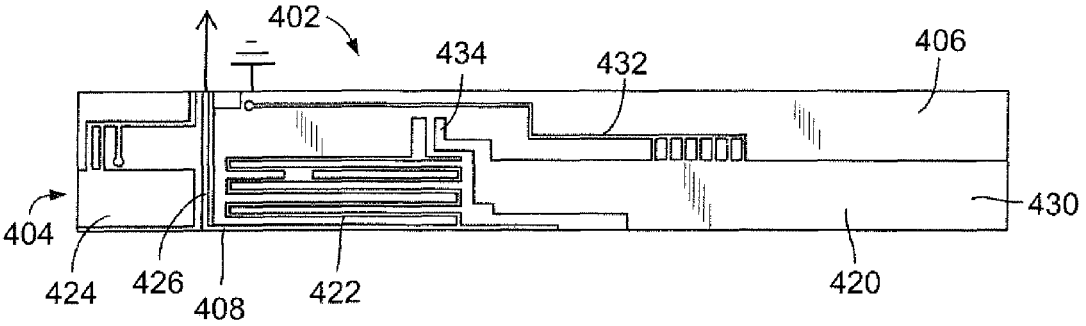
FIG. 18 illustrates an antenna formed in accordance with an exemplary embodiment.

FIG. 18 illustrates an antenna 402 formed in accordance with an exemplary embodiment. The antenna 402 is similar to the antenna 202 (shown in FIG. 4), however the antenna 402 includes mode elements 404 having different characteristics then the mode elements 204 (shown in FIG. 4) of the antenna 202. The antenna 402 includes an antenna circuit board 406. The mode elements 404 are defined by circuit traces on the antenna circuit board 406. The antenna 402 includes a feed line 408 defined by a conductive trace on the antenna circuit board 406.

In the illustrated embodiment, the antenna 402 includes four mode elements 404, however more or less antenna mode elements 404 may be utilized in alternative embodiments. The antenna 402 includes an LBLH mode element 420, an LBRH mode element 422, an HBLH mode element 424 and an HBRH mode element 426. In an exemplary embodiment, the HBRH mode element 426 is defined by the feed line 408.

The LBLH mode element 420 includes a cell 430 sized and shaped differently than the cell 230 (shown in FIG. 4). The LBLH mode element 420 includes a ground trace 432 connected to the cell 430. The cell 430 includes a capacitive tail 434 extending therefrom. The capacitive tail 434 extends along, and is positioned in proximity to, the LBRH mode element 422. The capacitive tail 434 increases capacitive coupling between the LBLH mode element 420 and the LBRH mode element 422 to affect antenna characteristics of the LBLH mode element 420 and the LBRH mode element 422. Optionally, a tuning element may be provided between, such as between the capacitive tail 434 and the LBRH mode element 422, the LBLH mode element 420 and the LBRH mode element 422 (or any other mode elements 404) to match the impedance of such mode elements 404. Tuning elements may be provided in series with, or shunted from, any of the mode elements 404 to provide tuning on such mode elements 404.

Figure 19:
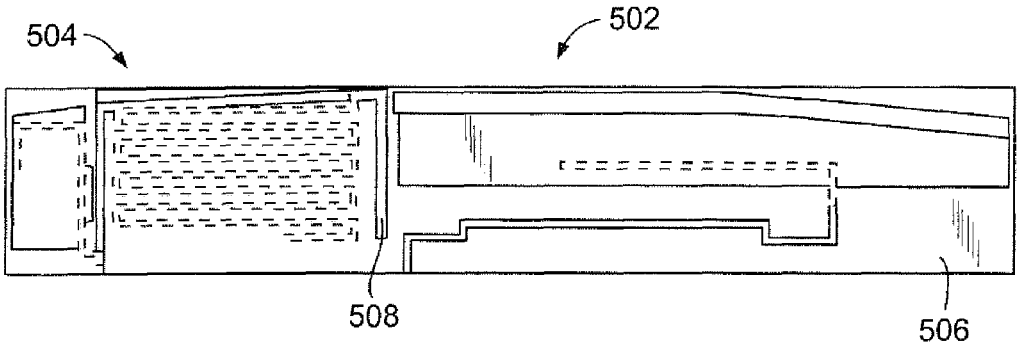
FIG. 19 illustrates an antenna formed in accordance with an exemplary embodiment.

FIG. 19 illustrates an antenna 502 formed in accordance with an exemplary embodiment. The antenna 502 includes a plurality of mode elements 504 on an antenna circuit board 506. The antenna 502 includes a feed line 508 defined by a circuit trace on the antenna 502. The antenna 502 is similar to the antenna 402 (shown in FIG. 18) and the antenna 202 (shown in FIG. 4), however the antenna 502 includes conductive traces on multiple layers of the antenna circuit board 506 that define the mode elements 504 (e.g. the portions of the conductive traces on a bottom layer are shown in phantom). Tuning elements may be provided in series with, or shunted from, any of the mode elements 504 to provide tuning on such mode elements 504.

Figure 20:
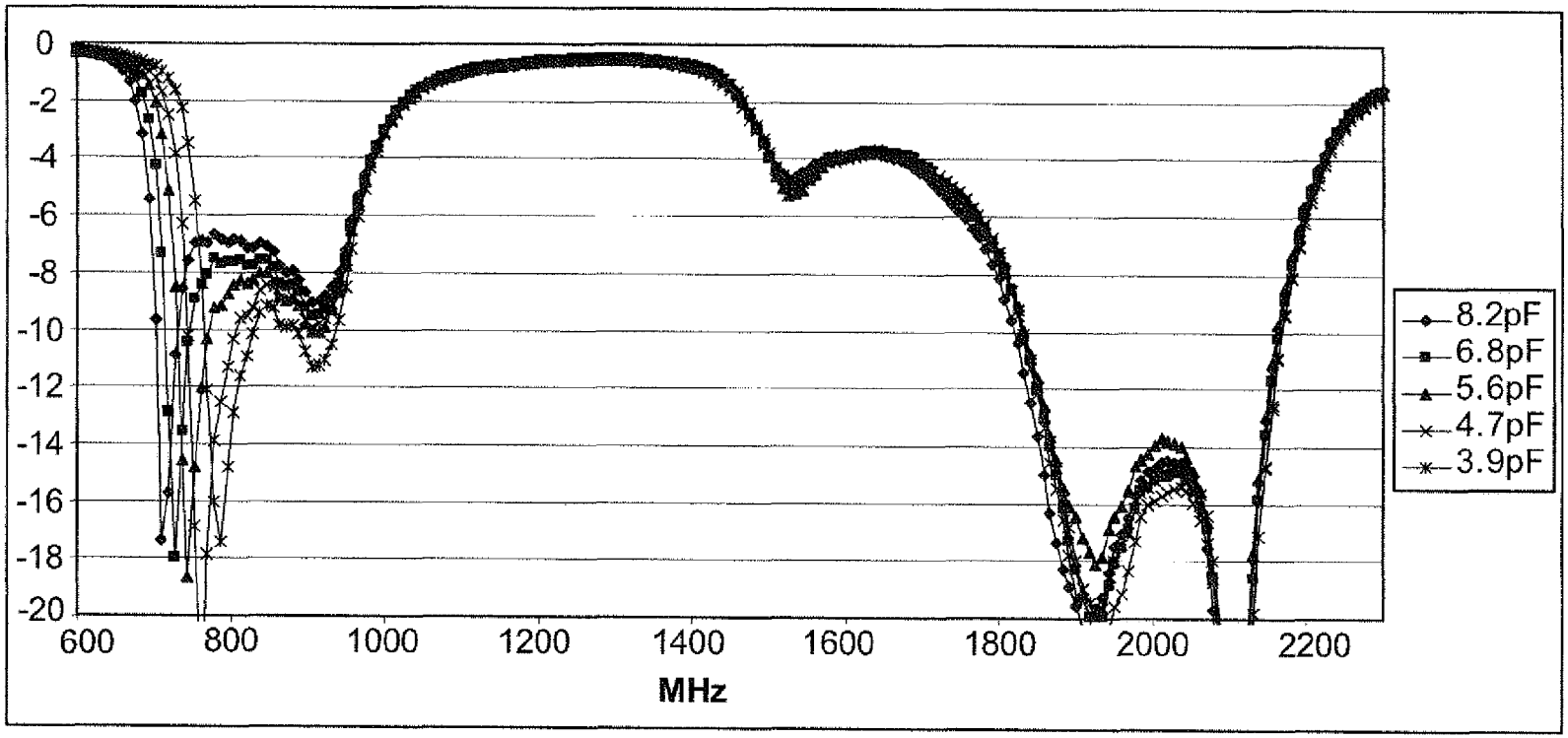
FIG. 20 is a graph showing return loss of the antenna at various frequencies.

FIG. 20 is a graph showing return loss of the antenna 202 at various frequencies. Different capacitance values (e.g. 3.9 pF, 4.7 pF, 5.6 pF, 6.8 pF, 8.2 pF) are used to tune the frequency of the LBLH mode element 220 across a frequency range of between approximately 700 MHz and 800 MHz. The resonant frequencies of the LBLH mode element 220 may be different by changing design characteristics of the tuning element(s) 134. The frequencies of the other mode elements 204 remain generally unaffected by the tuning of the LBLH mode element 220.

Figure 21:
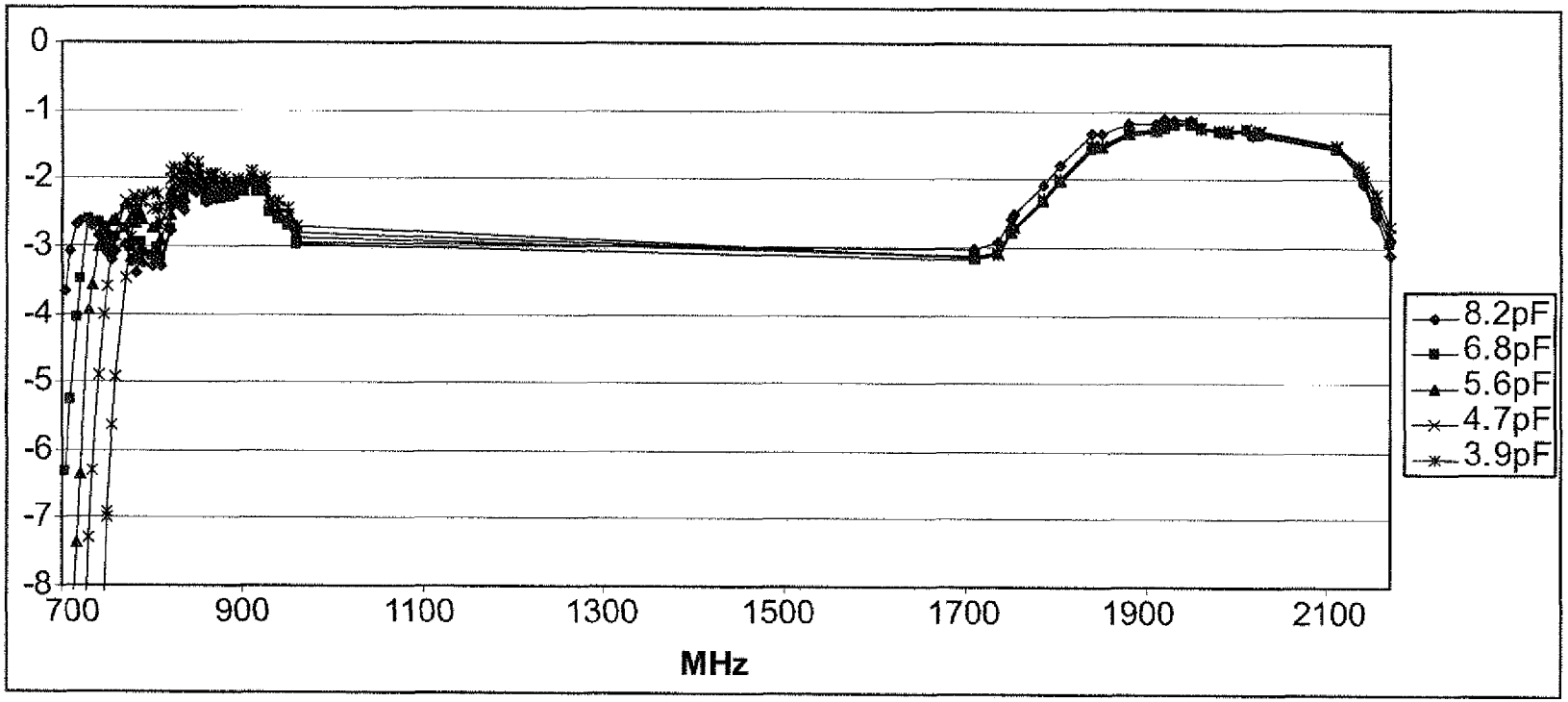
FIG. 21 is a graph showing efficiency of the antenna at various frequencies.

FIG. 21 is a graph showing efficiency of the antenna 202, measured in dB at various frequencies. Different capacitance values (e.g. 3.9 pF, 4.7 pF, 5.6 pF, 6.8 pF, 8.2 pF) are used to tune the frequency of the LBLH mode element 220 across a frequency range of between approximately 700 MHz and 800 MHz.

The antennas and tuning elements described herein provide multiple antenna mode elements, any of which can be tuned to control antenna characteristics thereof. The mode elements can be tuned to match impedance between corresponding mode elements. The tuning of the mode elements may be performed dynamically, in-situ and during operation of the wireless device. Having both right and left handed mode elements allow the antenna element to operate in multiple frequency bands, providing a wide bandwidth antenna. The combined right and left handed antenna is provided on an antenna circuit board having a small physical size as compared to antennas of comparable bandwidth that only include right handed elements. The antennas described herein are operable in multiple frequency bands simultaneously.

The tuning elements described herein provide different designs for connecting to different mode elements. The tuning elements allow the antenna to be tuned and operate efficiently in specific radio bands. The tuning elements allow the bands to be selected and varied dynamically. A tuning process over a wide range of frequencies in each band may be achieved without an alteration of the physical size or structure of the antenna. The selective tenability provided by the tuning elements permits a single mechanical embodiment of the antenna and wireless device to accommodate a variety of different frequency bands, which provides manufacturing and assembly economy. The tuning of the tuning elements may be electrically tuned via a processor in response to an internal program or one or more external signals. Alternatively, the tuning elements may be controlled by a manual operated switch, such as a switching device.

The same wireless device may be operated differently depending on various factors, such as geographic location, type of network, environmental factors, such as interference around the antenna, and the like. By way of example, the wireless device may be operable on both a cellular network and a wireless network. The tuning elements may tune the antenna to enhance performance on one type of network versus the other type of network based on the type of network being used to operate the wireless device. By way of another example, the wireless device may be handheld and the users hand may be positioned close to the antenna. In such situations, the antenna characteristics of one or more of the mode elements may be affected. The tuning elements may tune the corresponding mode element(s) in such situation to operate the antenna in a more efficient manner. By way of another example, the wireless device may be usable in different geographic locations, such as different countries, which utilize different frequency bands. The tuning device may tune the mode elements to operate the antenna in a more efficient manner based on the geographic location.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An antenna for a wireless device, the antenna comprising:

a low band left-handed (LBLH) mode element operable in a low frequency bandwidth, the LBLH mode element being capacitively coupled directly to a feed line of the antenna and being inductively coupled to a ground of the antenna;

a low band right-handed (LBRH) mode element operable in a low frequency bandwidth, the LBRH mode element being conductively coupled to the feed of the antenna;

a high band left-handed (HBLH) mode element operable in a high frequency bandwidth, the HBLH mode element being capacitively coupled directly to the feed line of the antenna and being inductively coupled to the ground of the antenna;

a high band right-handed (HBRH) mode element operable in a high frequency bandwidth, the HBRH mode element defined by at least a portion of the feed line of the antenna; and at least one tuning element being operatively coupled to at least one of the mode elements.

2. The antenna of claim 1, wherein the tuning element is a tunable capacitive element for active tuning of the corresponding mode element.

3. The antenna of claim 1, wherein the tuning element includes a ferroelectric capacitor having a voltage dependent dielectric constant to change a capacitance thereof.

4. The antenna of claim 1, wherein the tuning element comprises one of a variable capacitive, a varactor diode, a MEMS switched capacitor, or an electronically switched capacitor.

5. The antenna of claim 1, wherein the tuning element is an integral part of the corresponding mode element.

6. The antenna of claim 1, further comprising an antenna circuit board having discrete circuit traces defining the mode elements, the tuning element being terminated to the circuit traces of the corresponding mode elements.

7. The antenna of claim 1, further comprising an antenna circuit board having discrete circuit traces defining the mode elements, the antenna circuit board further comprising a power circuit electrically connected to the tuning element, voltage from the power circuit changing a capacitance of the tuning element.

8. The antenna of claim 1, further comprising an antenna circuit board having discrete circuit traces defining the mode elements, the tuning element being mounted to the antenna circuit board in series with the circuit traces of the corresponding mode elements.

9. The antenna of claim 1, further comprising an antenna circuit board having discrete circuit traces defining the mode elements, the tuning element being mounted to the antenna circuit board in a shunt between the corresponding circuit traces and the ground.

10. The antenna of claim 1, further comprising an antenna circuit board having discrete circuit traces defining the mode elements, the tuning element, including a series capacitor mounted to the antenna circuit board in series with the circuit traces of the corresponding mode elements, the series capacitor being a variable capacitor, the tuning element including an inductive trace in parallel with the series capacitor.

11. The antenna of claim 1, wherein the tuning element is operatively coupled to at least two of the mode elements, the tuning element providing matched tuning for the corresponding mode elements.

12. The antenna of claim 1, further comprising an antenna circuit board having discrete circuit traces defining the mode elements, the circuit trace defining the LBLH mode element includes a first cell and a first ground trace extending between the first cell and the ground, the circuit trace defining the LBRH mode element includes a meandering trace, the circuit trace defining the HBLH mode element includes a second cell and a second ground trace extending between the second cell and the ground, the circuit trace defining the HBRH mode element comprising a feed trace defining the feed line of the antenna, wherein the first cell is capacitively coupled to the feed trace and the first ground trace is inductively loaded, wherein the meandering trace taps into the feed trace, wherein the second cell is capacitively coupled to the feed trace and the second ground trace is inductively loaded.

13. The antenna of claim 12, wherein the tuning element is mounted to the antenna circuit board in series with the first ground trace, the second ground trace, the meandering trace, or the feed trace.

14. The antenna of claim 12, wherein the tuning element is mounted to the circuit board and shunted between the ground and the first ground trace, the meandering trace or the feed trace.

15. The antenna of claim 12, wherein the tuning element is mounted to the antenna circuit board and electrically connected between the feed trace and at least one of the first cell, the second cell, and the meandering trace.

16. An antenna for a wireless device, the antenna comprising:

a feed line;

a ground;

an antenna circuit board having left-handed mode elements and right-handed mode elements, the right-handed mode elements being conductively coupled to the feed line including at least one right-handed mode element defined at least in part by the feed line, the left-handed mode elements being capacitively coupled directly to the feed line and the left-handed mode elements being inductively coupled to the ground; and a tuning element on the antenna circuit board, the tuning element being operatively coupled to at least one of the left-handed mode elements and the right-handed mode elements, wherein the right handed mode elements include mode elements comprising a low band right-handed (LBRH) mode element operable in a low frequency bandwidth and a high band right-handed (HBRH) mode element operable in a high frequency bandwidth, and wherein the left handed mode elements include a low band left-handed (LBLH) mode element operable in a low frequency bandwidth and a high band left-handed (HBLH) mode element operable in a high frequency bandwidth.

17. The antenna of claim 16, wherein the tuning element is a tunable capacitive element for active tuning of the corresponding mode element.

18. The antenna of claim 16, wherein the antenna circuit board has discrete circuit traces defining the mode elements, the tuning element being terminated to the circuit traces of the corresponding mode elements.

19. The antenna of claim 16, wherein the antenna circuit board has discrete circuit traces defining the mode elements and a power circuit, the power circuit being electrically connected to the tuning element, voltage from the power circuit changing a capacitance of the tuning element.

20. The antenna of claim 16, wherein the mode elements are defined by discrete circuit traces on the antenna circuit board, wherein the LBRH mode element includes a meandering trace, the HBRH mode element comprises a feed trace defining the feed line of the antenna, the LBLH mode element includes a first cell and a first ground trace extending between the first cell and the ground, and the HBLH mode element includes a second cell and a second ground trace extending between the second cell and the ground; and wherein the first cell is capacitively coupled to the feed trace and the first ground trace is inductively loaded, wherein the meandering trace taps into the feed trace, wherein the second cell is capacitively coupled to the feed trace and the second ground trace is inductively loaded.

21. The antenna of claim 20, wherein the tuning element is mounted to the antenna circuit board in series with the first ground trace, the second ground trace, the meandering trace, or the feed trace.

22. The antenna of claim 20, wherein the tuning element is mounted to the circuit board and shunted between the ground and the first ground trace, the meandering trace or the feed trace.

23. The antenna of claim 20, wherein the tuning element is mounted to the antenna circuit board and electrically connected between the feed trace and at least one of the first cell, the second cell, and the meandering trace.

* * * * *